US007364433B2

(12) United States Patent
Neidlein

(10) Patent No.: US 7,364,433 B2
(45) **Date of Patent: *Apr. 29, 2008**

(54) ELECTRICAL CONNECTING APPARATUS

(75) Inventor: Hermann Neidlein, Steinheim (DE)

(73) Assignee: MagCode AG, Heidenheim (DE)

( * ) Notice: Subject to any disclaimer, the term of this patent is extended or adjusted under 35 U.S.C. 154(b) by 52 days.

This patent is subject to a terminal disclaimer.

(21) Appl. No.: 10/595,774

(22) PCT Filed: Oct. 29, 2004

(86) PCT No.: PCT/EP2004/012302

§ 371 (c)(1),
(2), (4) Date: May 10, 2006

(87) PCT Pub. No.: WO2005/046003

PCT Pub. Date: May 19, 2005

(65) Prior Publication Data

US 2007/0134947 A1 Jun. 14, 2007

(30) Foreign Application Priority Data

Nov. 10, 2003 (DE) ..... 203 17 436 U

(51) Int. Cl.
*H01R 12/00* (2006.01)

(52) U.S. Cl. ..... 439/66; 439/39

(58) Field of Classification Search ..... 439/66, 439/91, 591, 39

See application file for complete search history.

(56) References Cited

U.S. PATENT DOCUMENTS

| | | | | |
|---|---|---|---|---|
| 5,385,477 | A * | 1/1995 | Vaynkof et al. | 439/66 |
| 5,447,442 | A | 9/1995 | Swart | |
| 6,561,815 | B1 | 5/2003 | Schmidt | |
| 2002/0155735 | A1 | 10/2002 | Zhou et al. | |
| 2002/0182898 | A1 * | 12/2002 | Takahashi et al. | 439/39 |
| 2005/0255719 | A1 | 11/2005 | Heidlein | |

FOREIGN PATENT DOCUMENTS

| | | | |
|---|---|---|---|
| DE | 4439262 | A1 | 5/1996 |
| DE | 10242646.5 | A1 | 3/2004 |
| FR | 2566195 | A1 | 12/1985 |
| WO | 95/08910 | A1 | 3/1995 |
| WO | 01/03249 | A1 | 1/2001 |

* cited by examiner

*Primary Examiner*—Gary F. Paumen
(74) *Attorney, Agent, or Firm*—GrayRobinson, PA

(57) ABSTRACT

An electrical connecting apparatus has the following features: a current or data transmitter device which can be connected to at least one current-transmitting or pulse-transmitting source, is arranged in a transmitter housing and has contact elements. A current-receiving or data-receiving device which can be electrically connected to a load or consumer is arranged in a receiver housing and has contact elements. Current, pulses or data can be transferred between the contact elements, which are in the form of flat contacts with touching surfaces, by connecting the current or data transmitter device to the current-receiving or data-receiving device. A multiplicity of contact elements of at least one of the two devices are held next to one another in a holding body. The contact elements which are held in the holding body are elastically mounted. The contact elements rest on a pressing link on the side facing away from the contact elements of the other device.

16 Claims, 2 Drawing Sheets

ELECTRICAL CONNECTING APPARATUS

CROSS REFERENCE TO RELATED APPLICATIONS

This is a U.S. National Phase Entry Under 35 U.S.C. §371 of International Patent Application PCT/EP2004/012302 filed Oct. 29, 2004 to which priority is claimed and which, in turn, claims priority to German Patent Application No. 203 17 436.4 filed Nov. 10, 2003.

BACKGROUND OF THE INVENTION

1. Field of the Invention

The invention relates to an electrical connecting apparatus of the type having a current or data transmitter device which can be connected to at least one current-transmitting or pulse-transmitting source, is arranged in a transmitter housing and has contact elements, having a current-receiving or data-receiving device which can be electrically connected to a load or consumer, is arranged in a receiver housing and has contact elements, current, pulses or data being able to be transferred between the contact elements of the current or data transmitter device and the current-receiving or data-receiving device by connecting the current or data transmitter device to the current-receiving or data-receiving device, and a multiplicity of contact elements of at least one of the two devices being held next to one another in a holding body.

2. Description of the Related Art

WO 01/03249 A1 describes such a connecting apparatus. Elastically arranging or mounting the contact elements of at least one device makes it possible, even in the case of a multiplicity of contacts, to align the latter in an optimal manner with respect to one another and to connect them to one another with very good surface contact.

These measures ensure that even relatively high ampere levels can be transmitted and passed on. The earlier DE 102 42 646.5 proposed a further improvement of the electromechanical connecting apparatus mentioned at the outset such that the latter is even better suited to large-scale production and a multiplicity of contact connections. Said document proposed arranging a multiplicity of contact elements of at least one of the two devices next to one another in a configuration in the form of an array such that the contact elements used are elastically mounted and their rear side rests on a pressing link. This makes it possible to provide a multiplicity of contact connections in a very confined space, the individual contact elements, at the same time, being able to move independently of one another as a result of the elastic mounting, and optimal contact connections with touching surfaces resulting. This is ensured, in particular, by the fact that the rear sides of the contact elements jointly mounted or supported on a pressing link, it being possible for the latter to be elastic for this purpose. Additionally or alternatively, the contact elements may also be at least partially embedded in an elastic sheath in this case.

SUMMARY OF THE INVENTION

The present invention is now based on the object of making the electromechanical connecting apparatus mentioned at the outset even more suitable for large-scale production, in particular for simplification.

According to the invention, this object is achieved by virtue of the fact that a multiplicity of contact elements in at least one of the two devices are held next to one another in a holding body, the contact elements which are held in the holding bodies are elastically mounted, and the contact elements which are held in the holding body rest on a pressing link on the side facing away from the contact elements of the other device.

The holding body according to the invention may have a very simple configuration, for example a cuboid when seen in cross section. The holding body may be of any desired length in order to hold a multiplicity of contact elements. For the desired elastic mounting, the holding body itself may be elastic, and the pressing link, which may likewise be elastic, ensures that a uniform contact pressure is exerted on the contact elements of the other device.

The holding body may be in the form of a plastic part in which a multiplicity of holding slots for the contact elements are made. In this case, the contact elements may be arranged in the holding slots in an elastically resilient manner or else with play. When forming lateral play, tilting movements of the contact elements are possible in order to achieve large surface contacts.

In one advantageous design configuration, the holding body may be in the form of a housing lower part, while the pressing block is arranged in an upper housing part. In this case, the upper housing part may at least partially laterally surround the lower housing part, the upper housing part, for example when seen in cross section, being able to have at least approximately a U-shape for this purpose. In this case, the lower housing part is held between the two U-legs.

The pressing body may be arranged flush in the housing upper part. However, it is advantageous if, before mounting, there is a clearance on that side of the pressing body which faces away from the contact elements. Spacers of different thickness may then be inserted into the clearance. These spacers may be rigid or, like the pressing body, elastic. Different spacers enable different elasticities and thus different contact pressures for the contact elements to be produced for the contact elements of the other device.

In another refinement according to the invention, the elasticity or the contact pressure of the contact elements may also be influenced by the pressing body being provided with cutouts, grooves, channels or slots which are made in the pressing body, for example, between the contact elements which are arranged at a distance from one another. When closing or joining the contact elements of the two devices, material of the pressing body may then escape into the cutouts, grooves, channels or slots as a result of the pressure exerted.

The pressing body may also be provided with cutouts, grooves, channels or slots on the rear side facing away from the contact elements. This also allows the elasticity or the contact pressure to be set, it also being possible for material to be correspondingly displaced.

It goes without saying that, instead of making cutouts, grooves or channels and the like in the pressing body, said cutouts, grooves or channels and the like may also be made in that part of the housing on which the pressing body rests. In this case too, the cutouts, grooves, channels and the like are used to hold material of the pressing body.

In order to prevent the contact elements from falling out of the holding slots, the latter may be provided with stops.

Fields of use and applications of the electrical connecting apparatus may, for example, be the same as those described in WO 01/03249 A1. WO 01/03249 A1 also simultaneously represents the disclosure content of the present invention insofar as it is not described in any more detail below.

Advantageous developments and refinements of the invention emerge from the remaining subclaims and from the exemplary embodiment whose principle is described below with reference to the drawings, in which:

DETAILED DESCRIPTION

Figure 1:
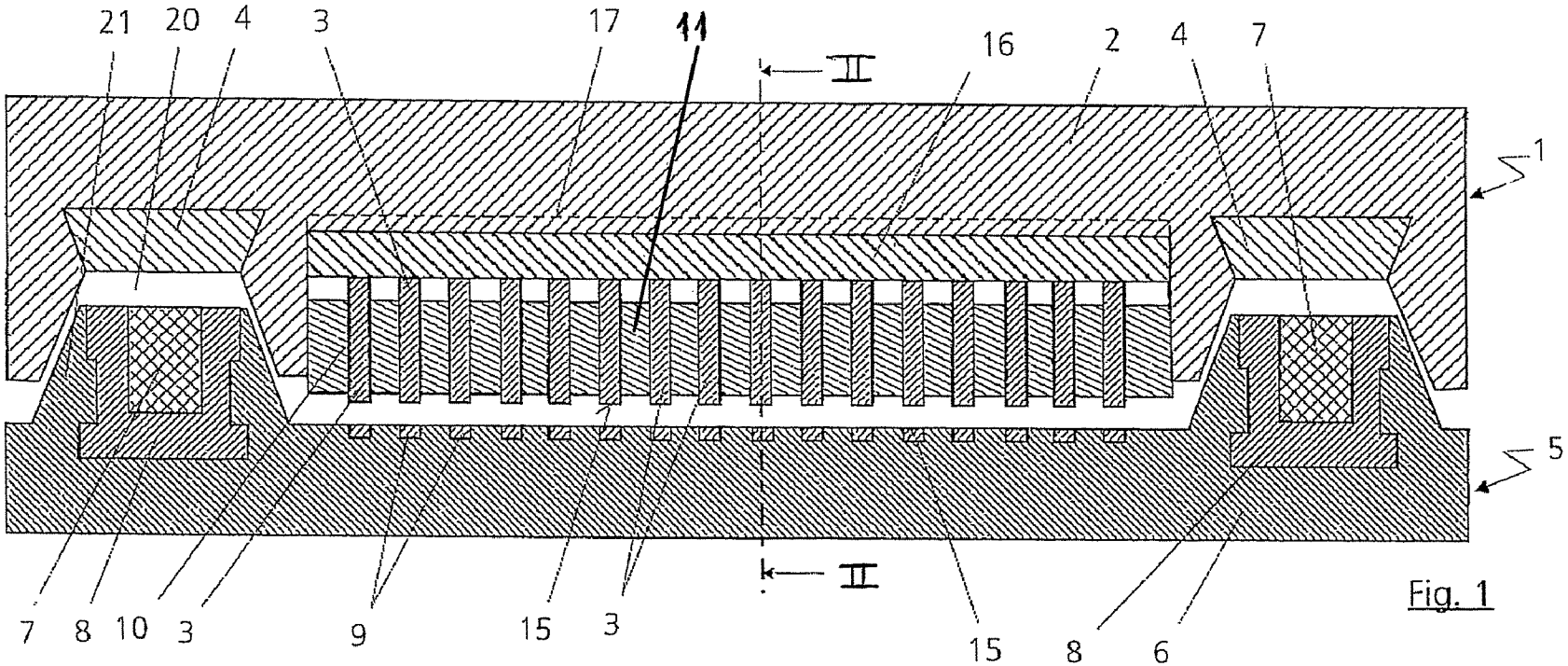
FIG. 1 is a longitudinal section through a preferred embodiment of an electrical connecting apparatus according to the invention.
Figure 2:
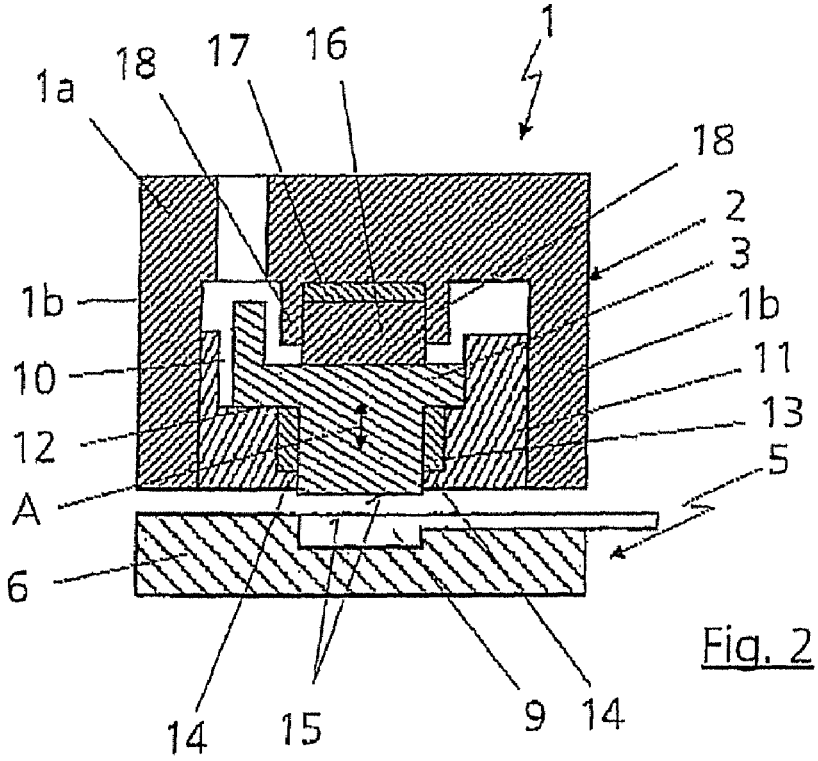
FIG. 2 is a cross section through the embodiment of FIG. 1, along the line II-II.

FIGS. 1 and 2 each show a current or data transmitter device 1 having a housing 2 in which a multiplicity of contact elements 3, which are in the form of surface contacts next to one another, are arranged. Two or else, if required, more magnet bodies 4 in the form of iron cores or magnets are arranged at a distance from one another in the transmitter housing 2.

For the purpose of an electrical connection, a current-receiving or data-receiving device 5 having a receiver housing 6 is arranged opposite the current or data transmitter device 1 in such a manner that magnets or magnet bodies 7 which are arranged in the receiver housing 6 are opposite the magnet bodies 4 which are arranged in the transmitter housing 2. If the magnet bodies 7 are in the form of magnets and the magnet bodies 4 are in the form of iron cores, it is not necessary to pay attention to the need for opposite polarity. If the magnet bodies 4 are likewise in the form of magnets, it must be ensured that opposite poles are respectively arranged opposite one another.

In order to reinforce the magnetic force, the magnets 7 may additionally also be sheathed with an iron casing 8, thus increasing the magnetic force.

For simplicity, the text below discusses only a current transmitter device 1 and a current-receiving device 5. It goes without saying that the two devices are also suitable for data transmission in the sense of a data transmitter device and a data-receiving device.

The term magnet bodies is used in an entirely general manner to denote magnets, parts which can be magnetized or magnetic parts which react magnetically under the influence of a magnet. The only important factor is that the magnet bodies 4 of the current transmitter unit 1 and those of the current-receiving device 5 interact in such a manner that a magnetic attraction force is produced on both parts by means of a magnetic field.

The current-receiving device 5 is likewise provided with contact elements 9 in the form of surface contacts which are arranged next to one another in the receiver housing 6 in such a manner that they are each arranged opposite the contact elements 3 of the current transmitter unit 1 when the current transmitter device 1 is connected to the current-receiving device 5.

FIGS. 1 and 2 each show the position shortly before the current transmitter device 1 makes contact with the current-receiving device 5 and thus shortly before a contact connection is made between the contact elements 3 and 9.

The contact elements 3 of the current transmitter device 1 are mounted in an arrangement in the form of an array in holding slots 10 of a holding body 11. As can be seen in FIG. 2, the contact elements 3 are arranged in a row next to one another with lateral play in the holding slots 10 (see FIG. 1). The holding slots 10 have a step or a respective stop 12 which prevents the contact elements 3 from falling out of the holding body 3. In the front region, that is to say on the side facing the current receiver device 5, there is a clearance between the contact elements 3 and the holding body 11, an elastic sealing element 13 being inserted into said clearance. The elastic sealing element 13 also ensures water-tightness. In order to guide the elastically mounted contact elements 3, the holding slots 10 are configured in such a manner that they each result, in the region of their front ends, in a reduced width in the region between the sealing element 13 and the front end of the holding body 11. As can be seen in FIG. 2, this results in lateral lugs 14 which laterally guide the contact elements 3.

If no sealing elements 13 are provided between the contact elements 3 and the holding body 11, there is no need for the lugs 14 and the contact elements 3 are then completely laterally guided as far as the stop 12.

The elastic sealing elements 13 may be applied or introduced, for example, as plastic in an injection-molding method or by means of molding. It goes without saying that the elastic sealing elements 13 may also be applied in another manner, for example in a prefabricated manner, the contact elements 3 then being introduced into the plastic in an appropriate manner.

Contact surfaces 15 of the contact elements 3 of the current transmitter device 1 and of the current-receiving device 5 rest on one another on their sides facing one another if the current transmitter device 1 is connected to the current-receiving device 5. The contact elements 3 rest on a pressing link or body 16 on that side of the contact elements 3 which faces away from the current-receiving device 5.

The pressing link 16 may be formed elastically and slightly concavely as a rubber link and is correspondingly arranged in a housing upper part 1*a* of the current transmitter device 1 between the two magnet bodies 4, with the result that it extends over the entire length of the holding body 11.

As can be seen in FIG. 2, the current transmitter device 1 is composed of a housing upper part 1*a* and a housing lower part, the housing lower part being formed, as a fundamental component, by the holding body 11. The housing upper part 1*a* laterally surrounds the housing lower part, said housing upper part having a U-shape (when seen in cross section) for this purpose. In this case, two U-legs 1*b* of the U-shape hold the holding body 11 as a lower housing part between them.

Before mounting, there is a clearance between the inner wall of the housing upper part 1*a* and the pressing body 16, a spacer 17 which preferably extends over the entire length of the pressing body 16 being inserted into said clearance. The pressing body 16 is guided by means of two lateral ribs 18 which are formed in the housing upper part 1*a*. In this case, the length of the ribs 18, which faces the contact elements 3, is selected in such a manner that the pressing body 16 completely fills the clearance between said ribs and the rear sides of the contact elements 3. In other words, even if there is no spacer 17 and the pressing body 16 thus directly rests on the inner wall of the housing upper part 1*a*, it is still possible to displace the contact elements 3 in order to compensate for tolerances, and there is sufficient play to maintain a correspondingly large contact area.

Being able to displace, and thus elastically mounting, the contact elements 3 by approximately 0.1 to 0.5 mm in arrow direction A will generally be sufficient.

Inserting spacers 17, which have different thicknesses, between the rear side of the pressing body 16 and the inner wall of the housing upper part 1*a* makes it possible to set the elasticity in a specific manner when the appropriate materials are selected.

Figure 3:
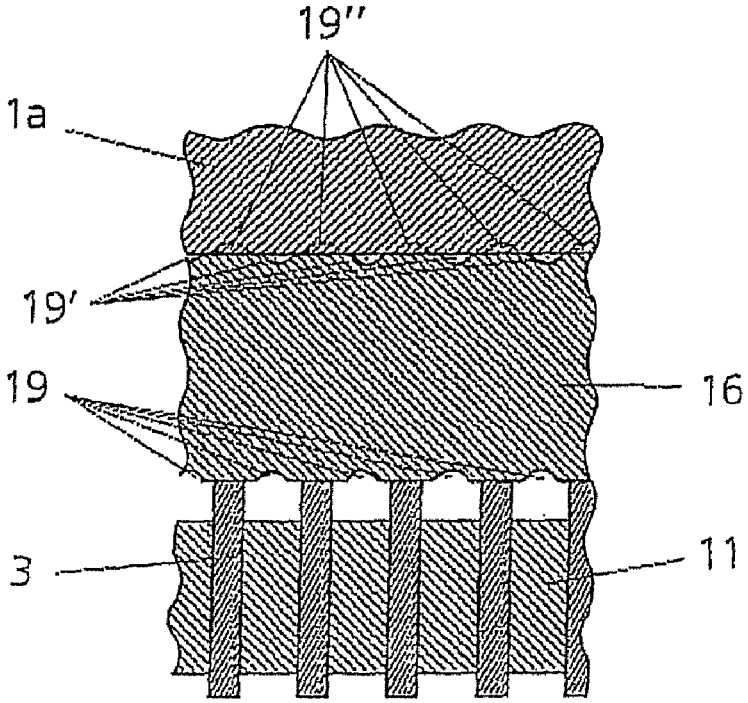
FIG. 3 is an enlarged, partial longitudinal section in another refinement.

The elasticity and thus the displacement distance of the contact elements 3 can also be achieved by providing the pressing body 16 with cutouts, grooves, channels or slots 19 on the side facing the contact elements 3, said cutouts, grooves, channels or slots being made in the holding body 11 between the contact elements 3 which are arranged at a distance from one another (see FIG. 3).

In addition or as an alternative to the cutouts, grooves, channels and slots 19 on the front side of the holding body 11, cutouts, grooves, channels or slots 19' may also be made in the rear side of the holding body 11, i.e. on that side of the holding body 11 which faces away from the contact elements 3. When the current transmitter device 1 is connected to the current-receiving device 5 and thus when a contact pressure is applied, material of the pressing body 16 may escape into the cutouts, grooves, channels or slots 19 and 19'.

The same effect is achieved if the inner wall of the housing upper part 1*a* is provided with cutouts, grooves, channels or slots 19", as illustrated using dashed lines in FIG. 3. The cutouts, grooves, channels or slots 19, 19' or 19" may run in the longitudinal direction or else in the transverse direction of the pressing body 16.

A silicone pressure pad, for example, may be used as the material for the pressing body 16. The contact elements 3 are essentially elastically mounted and are able to be displaced in arrow direction A by virtue of the fact that the rear side of the contact elements 3 rests on the elastic pressing link 16. Additionally or else alternatively, the required elasticity may also be achieved by virtue of the fact that the contact elements 3 are elastically held in an appropriate manner in the holding body 11 and/or the sealing element 13 is elastically held in an appropriate manner.

In the present exemplary embodiment, the contact elements 3 of the current transmitter device 1 are elastically mounted and held in the holding body 11. It goes without saying that, as an alternative to this, it is also possible, within the scope of the invention, to also provide the current-receiving device 5 with contact elements 9 which are elastically arranged in a corresponding manner, while the contact elements 3 of the current transmitter device 1 are fixedly arranged in the transmitter housing 2. It is likewise also possible to elastically mount all of the contact elements 3 and 9 in holding bodies 11.

As can be seen in FIG. 2, the contact elements 9, but also the contact elements 3, may be in the form of thin flat parts with lateral extensions 17. The lateral extensions 17 are then used to supply or pass on current to a load (not illustrated) via supply lines and output lines 18.

The holding body 11 may be formed from an elastic plastic part. Brass parts, which may be silver-plated, may be used as simple stamped parts for the contact elements 3 and 9.

In order to accurately mechanically supply or connect the current transmitter device 1 to the current-receiving device 5, the current transmitter device 1 may be provided with one or more conical cutouts 20 on whose rear or lower end a respective magnet body 4 rests. Conversely, the current-receiving device 5 has one or more conical extensions 21 which are matched to the cone angle of the conical cutouts 19. A respective magnet body 7 is situated in each conical extension 21. For the purpose of electrical connection, the conical extensions 21 are appropriately inserted into the conical cutouts 20 in a self-centering manner, the magnet bodies 4 and 7 resting on one another at the end of insertion and in the process producing the contact connections between the contact elements 3 and 9 in a stable and reliable manner. This refinement results in virtually "blind" contact connection of the contact elements 3 and 9 without any possibility of faults.

Further protection against faulty connections and contact connection between current transmitter devices 1 and current-receiving devices 5, which are not suited to one another, is achieved if the magnet bodies 4 and 7 are "coded". The term "coded" is used to mean that each magnet body is composed of a plurality of individual small magnet parts of different polarity, the magnet bodies 7 and 4 which are opposite one another respectively being arranged to have opposite polarity. Such coding can be seen, for example, in FIG. 3 of WO 01/03249 A1. Magnets which have been coded in this manner are also described in EP 0 573 471 (10.12.94). This means that contact connection can be effected only when the correctly coded magnets meet one another.

The exemplary embodiment described above is described in combination with the magnet bodies 4 and 7. It goes without saying that the magnet bodies 4 and 7 may also be dispensed with if required and, after the current-receiving or data-receiving device has been placed onto the current or data transmitter device, a connection or holding force between the two devices may also be provided in another manner, for example by locks or latches.

What is claimed is:

1. An electrical connecting apparatus, comprising:

a first device including a first housing which partially surrounds a plurality of first electrical contact elements, and a second device including a second housing which partially surrounds a plurality of second electrical contact elements, said first device and said second device being detachably mateable to one another to make electrical contact between said first electrical contact elements and corresponding ones of said second electrical contact elements when said first device and said second device are mated to one another, said first device further including a pressing body and a holding body, said holding body having a plurality of holding slots, each of said first electrical contact elements being mounted within a corresponding one of said holding slots, said pressing body being located between said first housing and said first electrical contact elements, at least one of said pressing body and said holding body being sufficiently elastic to permit said first electrical contact elements to be displaced relative to said first housing in at least (i) a first direction, away from the corresponding one of said second electrical contact elements, when said first device and said second device are mated to one another, and (ii) a second direction, toward the corresponding one of said second electrical contact elements, when said first device and said second device are detached from one another.

2. The electrical connecting apparatus as claimed in claim 1, further comprising an elastic sealing element at least a portion of which is located between said first electrical contact elements and said holding body.

3. The electrical connecting apparatus as claimed in claim 2, wherein said sealing element is molded into said holding body.

4. The electrical connecting apparatus as claimed in claim 2, wherein the sealing element is molded into said holding body by injection-molding.

5. The electrical connecting apparatus as claimed in claim 1, wherein said first electrical contact elements are mounted in said holding slots such that lateral play is present between said first electrical contact elements and said holding slots.

6. The electrical connecting apparatus as claimed in claim 1 wherein said first electrical contact elements can be displaced approximately 0.1 to 0.5 millimeter in said second direction.

7. The electrical connecting apparatus as claimed in claim 1 wherein said holding body comprises a lower part of said first housing, and said pressing body is disposed within an upper part of said first housing.

8. The electrical connecting apparatus as claimed in claim 7, wherein said upper part of said first housing at least partially laterally surrounds said lower part.

9. The electrical connecting apparatus as claimed in claim 8, wherein said upper part of said first housing has at least approximately a U-shaped cross section and said lower part of said first housing is held between two U-legs of said lower part of said first housing.

10. The electrical connecting apparatus as claimed in claim 7, further comprising at least one spacer located between said pressing body and said upper part of said first housing.

11. The electrical connecting apparatus as claimed in claims 1 wherein said pressing body is provided, on a side thereof facing said first electrical contact elements, with mutually spaced cutouts, grooves, channels or slots located between said first electrical contact elements.

12. The electrical connecting apparatus as claimed in claims 1 wherein said pressing body is provided with said cutouts, grooves, channels or slots on a side thereof facing away from said first electrical contact elements.

13. The electrical connecting apparatus as claimed in claim 1 wherein an interior part of said first housing which faces said pressing body includes a plurality of mutually spaced cutouts, grooves, channels or slots.

14. The electrical connecting apparatus as claimed in claim 1, wherein said holding body is formed of a plastic material.

15. The electrical connecting apparatus as claimed in claim 1, wherein said pressing body comprises of a silicone pressure pad.

16. The electrical connecting apparatus as claimed in claim 1, wherein said holding slots are provided with stops which engage said first electrical contact elements to limit displacement of said first electrical contact elements in said second direction.

* * * * *